US009644294B2

(12) United States Patent
Zachi De Osti et al.

(10) Patent No.: US 9,644,294 B2
(45) Date of Patent: May 9, 2017

(54) DEVICE FOR MANUFACTURING A FIBROUS PRODUCT

(71) Applicant: SAINT-GOBAIN ISOVER, Courbevoie (FR)

(72) Inventors: Fernando Zachi De Osti; Bernard Baudouin, Saint Paul (FR)

(73) Assignee: SAINT-GOBAIN ISOVER, Courbevoie (FR)

( * ) Notice: Subject to any disclaimer, the term of this patent is extended or adjusted under 35 U.S.C. 154(b) by 0 days.

(21) Appl. No.: 14/893,303

(22) PCT Filed: May 22, 2014

(86) PCT No.: PCT/FR2014/051208
§ 371 (c)(1),
(2) Date: Nov. 23, 2015

(87) PCT Pub. No.: WO2014/188135
PCT Pub. Date: Nov. 27, 2014

(65) Prior Publication Data

US 2016/0168771 A1 Jun. 16, 2016

(30) Foreign Application Priority Data

May 24, 2013 (FR) ..... 13 54728

(51) Int. Cl.
*D04H 1/44* (2006.01)
*D04H 1/4209* (2012.01)
(Continued)

(52) U.S. Cl.
CPC ..... *D04H 1/44* (2013.01); *D04H 1/4209* (2013.01); *D04H 1/4218* (2013.01);
(Continued)

(58) Field of Classification Search
CPC ..... D04H 1/4209; D04H 1/4218; D04H 1/44; D04H 1/558
See application file for complete search history.

(56) References Cited

U.S. PATENT DOCUMENTS 2,246,987 A * 6/1941 Roos ..... B28B 5/027 156/347
2004/0191350 A1 9/2004 Qi

OTHER PUBLICATIONS

International Search Report issued Sep. 15, 2014 in PCT/FR2014/051208 filed May 22, 2014.

* cited by examiner

*Primary Examiner* — Joseph S Del Sole
*Assistant Examiner* — Joseph Leyson
(74) *Attorney, Agent, or Firm* — Oblon, McClelland, Maier & Neustadt, L.L.P.

(57) ABSTRACT

This forming device is intended to be mounted on a flight (6) of a conveyor for transporting a fibrous product through a heating device, where the flight (6) defines a receiving surface (63) for the fibrous product. The forming device has a forming block (8), a main part (81) of which is intended to be arranged at the front of the receiving surface (63), and at least one anchoring element (9) which is intended to be fixed to the flight by being arranged at the rear of the receiving surface (63). The forming block (8) and the anchoring element (9) comprise complementary snap-fastening members (89, 99) which, when the main part (81) of the forming block (8) is opposite the receiving surface (63) and the anchoring element (9) is fixed to the flight (6) at the rear of the receiving surface (63), are able to engage by the application of a one-way pushing force ($F_1$) that pushes the main part (81) of the forming block (8) towards the receiving surface (63) in a transverse direction (X) with respect to the receiving surface (63).

17 Claims, 5 Drawing Sheets

(51) Int. Cl.
*D04H 1/4218* (2012.01)
*D04H 1/558* (2012.01)

(52) U.S. Cl.
CPC ..... *D04H 1/558* (2013.01); *D10B 2101/06* (2013.01); *D10B 2505/00* (2013.01)

Fig.2
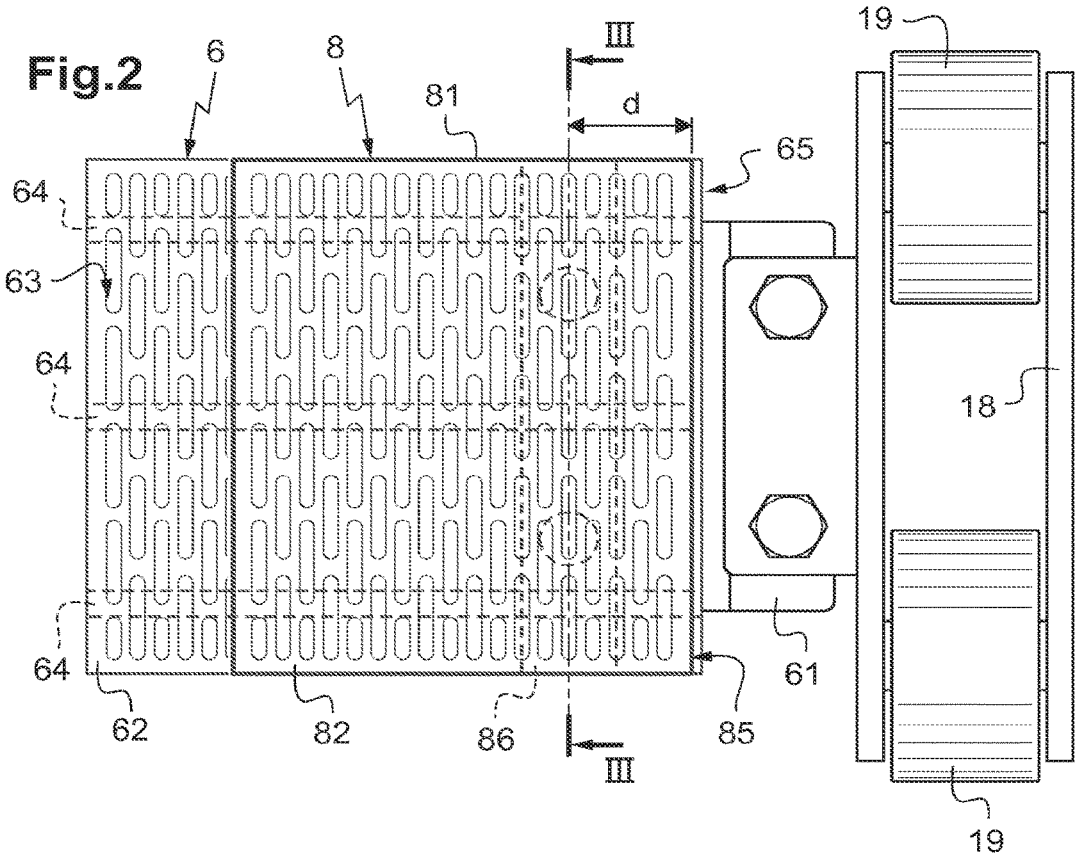
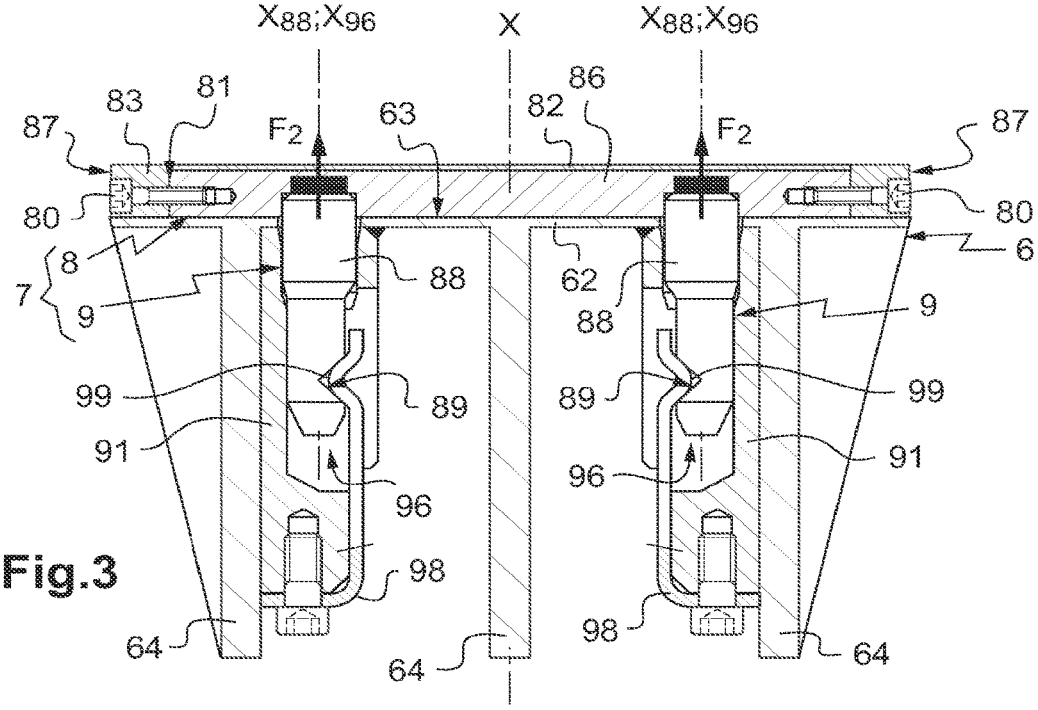
Fig.3

DEVICE FOR MANUFACTURING A FIBROUS PRODUCT

The present invention relates to a forming device for creating a form in a fibrous product, this forming device being intended to equip a conveyor flight for transporting the fibrous product through a heating device. The invention also relates to a device for manufacturing a fibrous product, comprising such a forming device.

A fibrous insulation product, for example an insulation panel for an air distribution duct, conventionally consists of a blanket of mineral fibres, such as glass fibres, which are bound together by an organic binder. The manufacture of such fibrous panels comprises first of all fiberizing and depositing fibres on a perforated mobile transporter or conveyor. The mass of fibres is pressed on to the conveyor with the aid of suction boxes that are arranged under the conveyor. During fiberizing, a binder is sprayed in the form of a solution or suspension in a volatile liquid such as water on to the drawn fibres, this binder having properties of heat-activatable adhesiveness. The binder usually comprises a heat-curable material, such as a thermosetting resin, for example a phenol/formaldehyde resin.

The primary layer of relatively loose fibres on the collector conveyor is then transferred to a heating device, for example a crosslinking oven or a microwave heating device. The blanket of fibres passes through the heating device by virtue of additional perforated conveyors. Conventionally, two conveyors are disposed facing one another, being spaced apart by a distance appropriate for determining the thickness of the fibrous panel. Each strand of the conveyors comprises a plurality of flights consisting of mutually articulated grilles that are perforated so as to be permeable to air and other gases emitted during the heating of the blanket. The fibrous panel thus has a greater or lesser density depending on the degree of compression exerted by the two conveyors in the heating device.

As it passes through the heating device, the blanket is dried and subjected to a specific thermal treatment which cures the binder present on the surface of the fibres. This curing also brings about crosslinking of the fibres with one another in a three-dimensional structure, that is to say a bond via the thermosetting binder at the points of contact between the fibres, and thus stabilization of the blanket at the desired thickness for the fibrous panel, while retaining elasticity.

As a variant, it is possible for the blanket of fibres not to be provided with binder before heating. The shaping and stabilization of the fibrous panel may then result from a simple agglomeration of the fibres by a high pressure and a high temperature being applied to the blanket of fibres. In this case, the heating device is generally a heating forming press.

In order to assemble fibrous panels which are juxtaposed edge to edge, or in order to fold a fibrous panel over in a contiguous manner on itself, for example in order to form a duct, it is furthermore known to form rabbets on the edges of the panels. Each rabbet of a panel is intended to be interlocked with a complementary rabbet, either on an adjacent panel in the case of juxtaposed panels, or on the same panel in the case of a panel folded over on itself. A conventional method for forming rabbets employs forming blocks, or "shiplap shoes", which are fixed in the heating device on opposite edges of the two conveyors facing each other, so as to compress the longitudinal edges of the fibrous panel. Thus, the longitudinal edges of the fibrous panel are brought to a greater density compared with the rest of the panel, thereby forming the rabbets.

It is frequently desirable to use one and the same heating device for manufacturing fibrous panels with and without rabbets, or fibrous panels having rabbets of different sizes. However, the forming blocks are sometimes welded permanently to the flights of the conveyors. As a variant, the forming blocks may be bolted onto the flights of the conveyors. They then have to be removed and replaced each time the type of rabbet is changed. However, mounting and removing such bolted forming blocks is time-consuming and tedious. In particular, screwing and unscrewing have to be carried out while running the conveyor at low speed, with a part of the operator's body entering the heating device, this only being able to take place when the heating device is cold. In addition, the presence of the screws and of the positioning devices considerably reduces the surface area for the passage of convection air, this resulting in poor baking of the edges of the panels.

Furthermore, US 2004/0191350 A1 describes a removable device for fixing forming blocks on the flights of an oven conveyor, said device employing retaining members combined with locking balls. Each retaining member can pass between a locked configuration, in which the locking balls project relative to the retaining member and immobilize it with respect to a collar of the forming block, and an unlocked position, in which the locking balls are retracted into the internal volume of the retaining member so as to allow it to be freed relative to the collar of the forming block. In practice, the passage of the retaining member between the locked and unlocked configurations is activated with the aid of cams which are moved parallel to the conveyor, thereby allowing the forming block to be mounted and removed. This device for fixing with locking balls is complex and costly. In addition, there is a risk of the ball mechanism becoming soiled over time, this limiting the reliability of the fixing system in the long term. Furthermore, the need to use quite specific cams for passing between the locked and unlocked configurations complicates the mounting and removal of the forming block, while increasing the cost of the device. It is also noted that the cams are moved at the rear of the flights of the conveyor, at the location where means for sealing the oven, in particular in the form of brush seals, are usually provided. The use of cams is thus disadvantageous since it results in leaks of hot air.

It is these drawbacks which the invention intends more particularly to remedy by proposing a forming device the mounting and removal of which with respect to a conveyor of a heating device, in particular an oven conveyor, can be carried out easily and rapidly, including when the conveyor is still hot, without causing any risk to the operator, this device ensuring reliable and durable retention in place on the conveyor, the structure of this device also being simple and making it possible to equip any type of conveyor at low cost.

To this end, one subject of the invention is a forming device for creating a form in a fibrous product, this forming device being intended to be mounted on a flight of a conveyor for transporting the fibrous product through a heating device, the flight defining a receiving surface for the fibrous product and the forming device having:

- a forming block, a main part of which is intended to be arranged at the front of the receiving surface, and
- at least one anchoring element, which is intended to be fixed to the flight while being arranged at the rear of the receiving surface, characterized in that the forming block and the anchoring element comprise complementary snap-fastening members which, when the main part of the forming block is facing the receiving surface and the anchoring element is fixed to the flight at the rear of the receiving surface, are able to engage by the application of a one-way pushing force that pushes the main part of the forming block towards the receiving surface, in a transverse direction with respect to the receiving surface.

In the context of the invention, the terms "front" and "rear" are used to define a position with respect to the fibrous product receiving surface defined by the flight. Within the meaning of the invention, elements are arranged at the front of the receiving surface when they are contained in the half-space which faces, or which is opposite, the receiving surface, while elements are arranged at the rear of the receiving surface when they are contained in the other half-space.

By virtue of the invention, once the conveyor flight has been equipped with the anchoring element, it is possible to mount the forming block directly, by positioning the main part of the forming block opposite the receiving surface and by applying a one-way pushing force that pushes the main part of the forming block towards the receiving surface, in a transverse direction with respect to the receiving surface. Mounting the forming block on the flight is thus easy and rapid.

Preferably, the snap-fastening members are dimensioned such that their engagement can be actuated by human force, optionally with the aid of a hand tool such as a mallet, but without requiring the use of electrical energy.

According to an advantageous feature, the flight defines an internal volume at the rear of the receiving surface and the anchoring element is designed to be housed in this internal volume without protruding from the rear of the internal volume. Such an anchoring element housed, or "embedded", in the volume of the flight has the advantage of not disturbing the passage of air in the heating device, thereby promoting optimum baking of the fibrous product. In addition, since the anchoring element is located under the receiving surface of the flight, it is protected from the baking residues of the fibrous products, thereby making it possible to avoid undesirable sticking.

According to another advantageous feature, the snap-fastening members, when they are engaged, elastically retain the forming block with respect to the anchoring element. The expression "elastically retain" is understood here to mean the fact that the snap-fastening members are able to elastically absorb at least a part of the forces that are likely to act on them during the operation of the conveyor. In particular, the snap-fastening members are able to remain engaged in opposition to forces which tend to disassemble them, such as forces resulting from the vibrations inherent to the operation of the conveyor.

Preferably, at least one of the snap-fastening members is formed by a leaf spring, which helps to elastically retain the forming block with respect to the anchoring element. This leaf spring is advantageously made from a metal alloy for which the variation in the elastic limit is less than 30% in relative terms, preferably less than 20% in relative terms, in the range of temperatures from 20° C. to 300° C. Thus, the leaf spring fulfils its function of absorbing forces even at high temperatures, and in particular over the entire range of temperatures that are likely to be applied in the heating device. By way of example, the leaf spring may be made from a steel of suitable composition, or from a nickel/chromium-based superalloy.

According to one aspect of the invention, the snap-fastening member of the anchoring element has an entry surface which forms a hard point for the engagement of the snap-fastening members, this entry surface being inclined with respect to the direction of the pushing force at an angle of less than or equal to 45°, preferably between 10° and 30°, so as to allow the passage of the hard point during the application of the pushing force. The amplitude of the pushing force to be applied in order for the snap-fastening members to be engaged may thus be adapted by acting on the inclination of the entry surface, it being understood that engagement is all the more difficult, the greater the inclination angle of the entry surface is with respect to the direction of the pushing force.

According to one aspect of the invention, the snap-fastening members are able to be disassembled by the application of a separating force for separating the forming block from the receiving surface, in a transverse direction with respect to the receiving surface. In order to retain the snap-fastening members in engagement, the snap-fastening member of the anchoring element has a retaining surface which forms a hard point for the disassembly of the snap-fastening members, this retaining surface being inclined with respect to the direction of the separating force at an angle of approximately equal to 45°, so as to allow the passage of the hard point during the application of the separating force. The inclination angle of the retaining surface with respect to the direction of the separating force remains less than 45°, preferably being close to 45°, knowing that an angle greater than 45° prevents the disassembly of the snap-fastening members, while an angle that is less than 45° by too much does not ensure that the snap-fastening members are retained sufficiently in engagement.

According to one advantageous feature, the forming block has at least one opening which, in the configuration in which the forming device is mounted on the flight, is located at the front of the receiving surface, the snap-fastening members being able to be disassembled by the application, through the lateral opening, of a separating force for separating the forming block from the receiving surface in a transverse direction with respect to the receiving surface. Preferably, the forming device is arranged in the vicinity of a lateral edge of the flight, with the lateral opening in the forming block being oriented towards this lateral edge. It is thus possible to remove the forming block from outside the heating device by passing an appropriate tool into the lateral opening in the forming block, said opening being located at the front of the receiving surface of the flight, and by applying the separating force with the aid of this tool, so as to disassemble the snap-fastening members. Once disconnected from the flight, the forming block is conveyed towards the outlet of the heating device by the conveyor.

Advantageously, the forming block comprises at least two snap-fastening members projecting from its main part, said snap-fastening members each being able to engage with a snap-fastening member of the anchoring element. The two snap-fastening members are preferably at a distance from one another so as to ensure that the forming block is retained without the forming block possibly rotating with respect to the anchoring element. In one embodiment, the forming device comprises means for preventing the forming block from rotating with respect to the anchoring element or with respect to the receiving surface, thereby ensuring that the forming block is retained in place reliably on the flight, even when the fibrous product in place on the conveyor exerts forces on the forming block.

Advantageously, the main part of the forming block is perforated so as not to disrupt the circulation of air in the heating device.

A further subject of the invention is a device for manufacturing a fibrous product, comprising:

a heating device, a lower conveyor and an upper conveyor which circulate in the heating device, each conveyor comprising a plurality of flights that each define a receiving surface for the fibrous product, the lower and upper conveyors being arranged so as to compress the fibrous product between the receiving surfaces when they transport the fibrous product through the heating device, this device being such that at least one of the lower conveyor and upper conveyors has at least one flight that is provided with a forming device as described above.

Preferably, the forming device is arranged in the vicinity of a lateral edge of the conveyor.

In one embodiment, the lower conveyor has forming devices that equip the flights on one edge of the two facing conveyors, while the upper conveyor has forming devices that equip the flights on the opposite edge of the two facing conveyors. Such an arrangement makes it possible to form opposing rabbets, one male and the other female, on the two lateral edges of the fibrous product.

The features and advantages of the invention will become apparent from the following description of two embodiments of a forming device and a device for manufacturing a fibrous product according to the invention, said description being given only by way of example and with reference to the appended drawings, in which:

FIG. 2 is a top view of a flight of one of the conveyors of the heating device of FIG. 1, this flight being equipped with a forming device in accordance with a first embodiment of the invention;

FIG. 3 is a cross section along the line III-III in FIG. 2;

Figure 1:
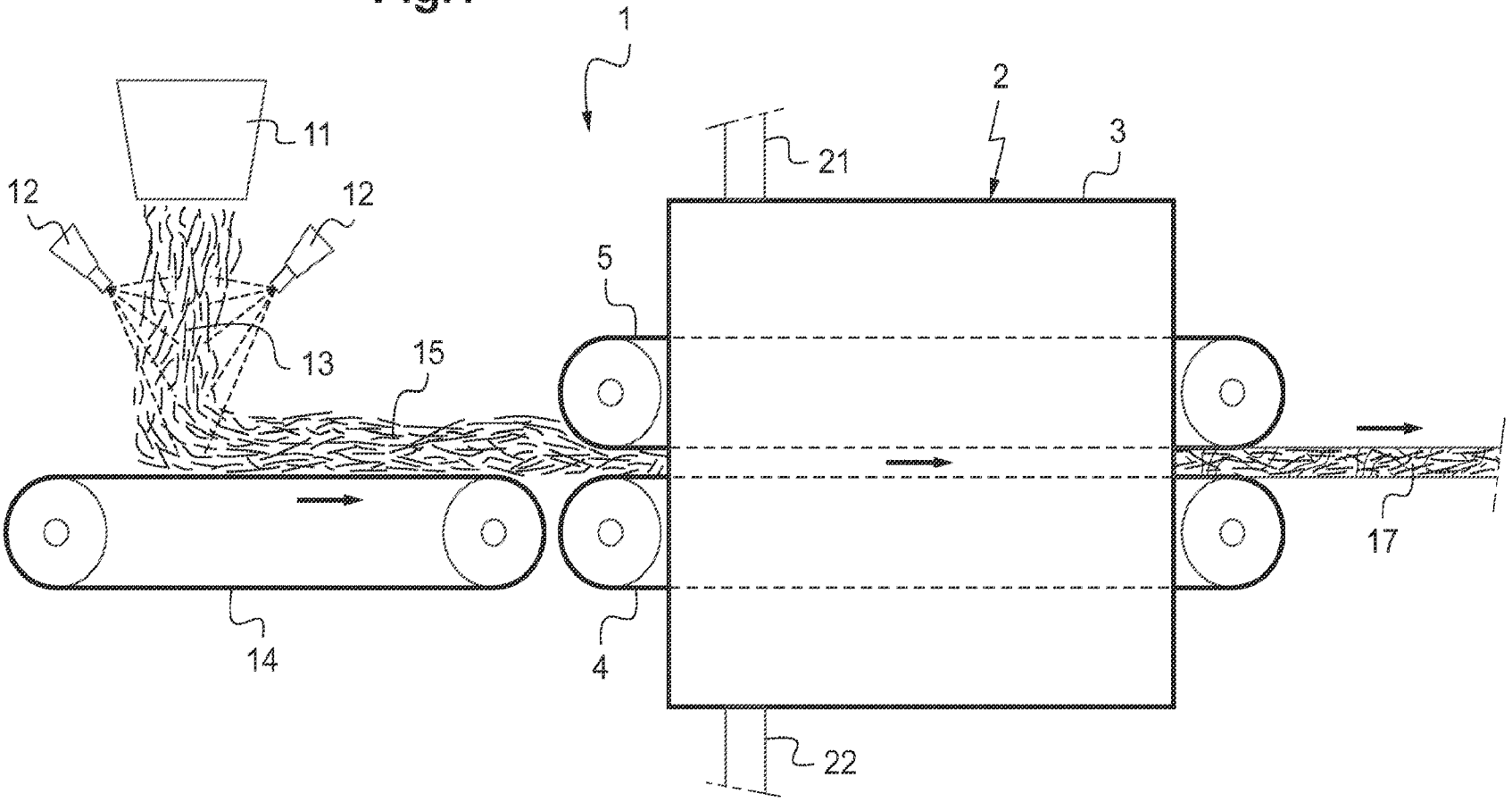
FIG. 1 is a schematic elevation view of a device for manufacturing a fibrous product in accordance with the invention.

FIG. 1 schematically shows a device 1 for manufacturing a fibrous product based on glass wool, for example for manufacturing insulation panels for air distribution ducts. This device 1 comprises a fiberizing unit 11 to which molten glass is supplied, in the usual manner, from a furnace and by way of a forehearth (these not being shown). The device 1 comprises binder applicators 12 that are provided to apply, in particular by spraying, a binder to the web of fibres 13 produced by the fiberizing unit 11. The fibres are collected on a perforated conveyor 14, in the form of a blanket 15 of fibres of glass wool mixed with the binder. The binder may be a thermosetting resin, such as a phenol/formaldehyde resin, or any other type of appropriate binder.

At the end of the conveyor 14, the device 1 comprises a crosslinking oven 2. This oven 2 has a closed chamber 3 in which a lower conveyor 4 and an upper conveyor 5 for transporting and calibrating the blanket 15 circulate. Each conveyor 4 or 5 comprises, in a conventional manner, a plurality of mutually articulated flights 6 that are perforated in order to be permeable to gases. The oven 2 has a supply duct 21 for the introduction of hot gases for baking the blanket, and an escape duct 22 for evacuating fumes that result from the baking of the blanket, in particular from the vaporization of the water contained in the blanket. The conveyors 4 and 5 are disposed facing one another, being spaced apart by an appropriate distance. While allowing the passage of hot gases, thereby promoting the rapid take-up of the binder, the conveyors 4 and 5 compress the blanket 15 in order to give the latter the desired thickness of the fibrous panel 17 at the outlet of the oven 2. By way of example, for a rolled panel, the thickness of the panel is conventionally between 10 and 450 mm, the density of the layer of glass wool being for example between 5 and 150 kg/m$^3$.

The flights 6 of the conveyors 4 and 5 are combined with support means, positioned inside the oven 2, which guide the movement of the flights. For each flight, the support means comprise for example a carriage 18 that is provided with wheels 19 and is connected to a lateral lug 61 of the flight, as shown in FIG. 2. The carriages 18 for the different flights are intended to circulate along rails (not shown) and may be moved through the oven 2 by any means, in particular with the aid of a chain.

Figure 4:
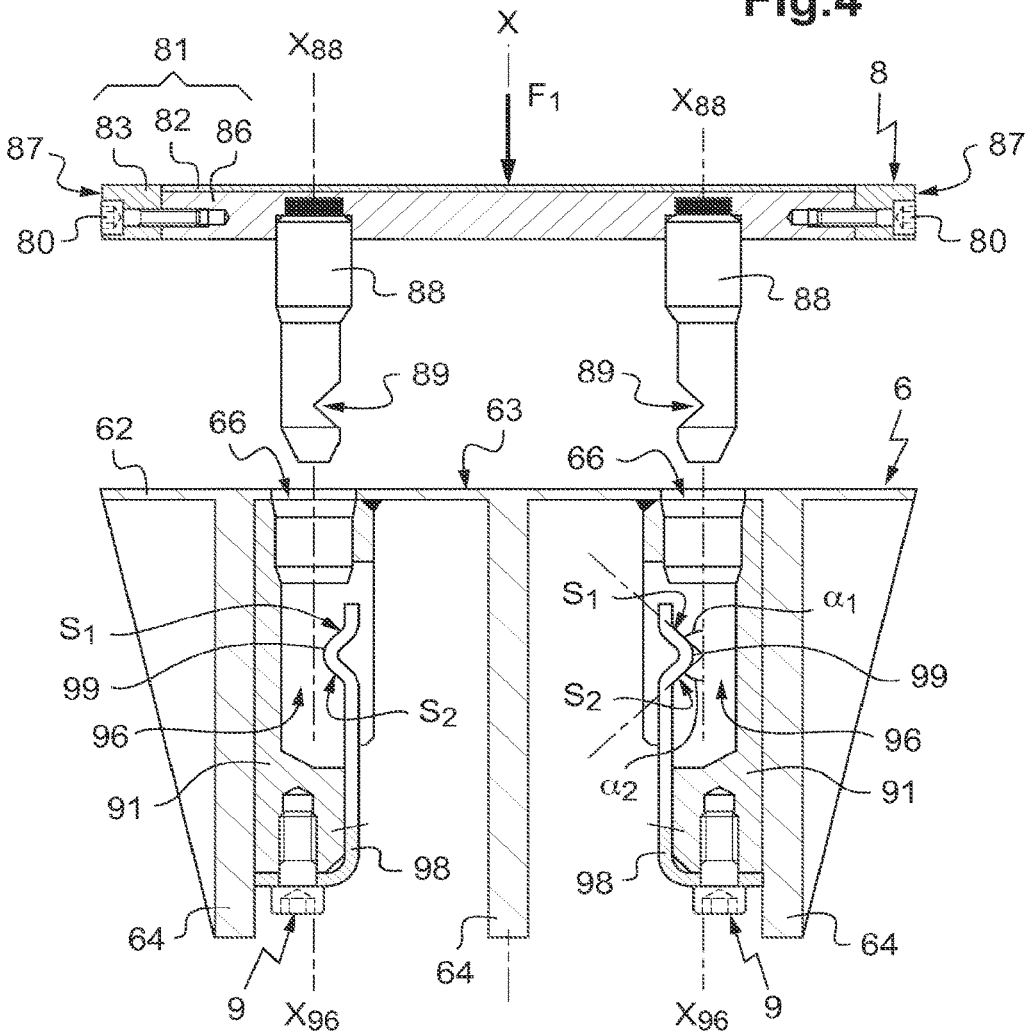
FIG. 4 is a cross section similar to FIG. 3 but in an exploded view.

The first embodiment employs a first known model of conveyor flight, clearly visible in FIGS. 3 and 4. The flight 6 has a perforated grille 62 with a rectangular shape, which defines a receiving surface 63 for the blanket. The lug 61 for connecting to the support carriage 18 is located in the vicinity of a lateral edge 65 of the grille 62. The grille 62 is connected, at the rear of the receiving surface 63, to three mutually parallel elongate ribs 64, namely a central rib and two lateral ribs, all three of which have the same height perpendicularly to the grille 62 and extend approximately perpendicularly to the lateral edge 65. The lateral edge 65 of the flight is intended to be positioned at the border of the conveyor, the ribs 64 then being arranged perpendicularly to the direction of circulation of the conveyor.

In accordance with the invention, the flight 6 is provided with a forming device 7, intended to be mounted on the flight in the vicinity of the lateral edge 65. The forming device 7 has a forming block 8, a main part 81 of which is intended to be arranged at the front of the receiving surface 63, so as to create a form in the blanket 15 as it passes through the oven. The forming device 7 also has two anchoring casings 9 that are designed to be fixed at the rear of the receiving surface 63, being housed integrally in the internal volume of the flight 6, this being the volume delimited by the ribs 64 at the rear of the grille 62.

The anchoring casings 9 are fixed in the vicinity of the lateral edge 65, at the rear of the receiving surface 63, each bearing against a lateral rib 64 of the flight, for example by being welded to this lateral rib. Each casing 9 has a sleeve 91 which defines a housing 96 centred on an axis $X_{96}$. The housing 96 of each casing 9 is positioned so as to correspond with an orifice 66 in the grille 62 of the flight. A leaf spring 98 is secured to the sleeve 91 so as to form an edge of the housing 96 that is closest to the central rib 64. The leaf spring 98 is made of a steel of suitable composition, for which the variation in the elastic limit is less than 30% in relative terms in the range of temperatures from 20° C. to 300° C., such that the leaf spring retains its elastic properties even at the high temperatures that prevail in the oven.

Figure 5:
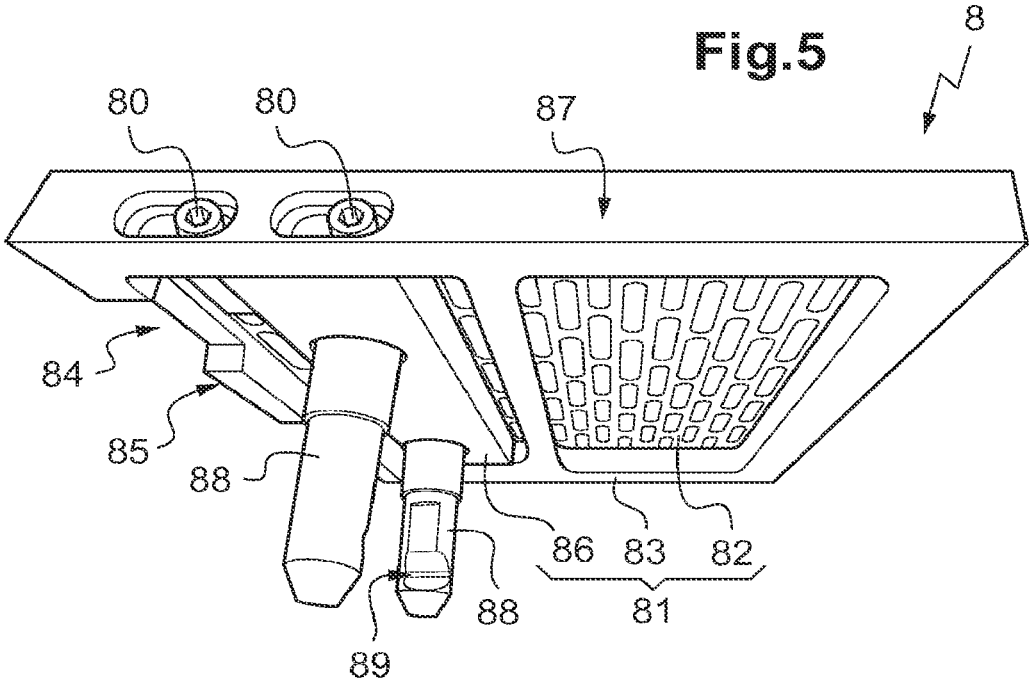
FIG. 5 is a perspective view of the forming block of the forming device of FIGS. 2 to 4.
Figure 6:
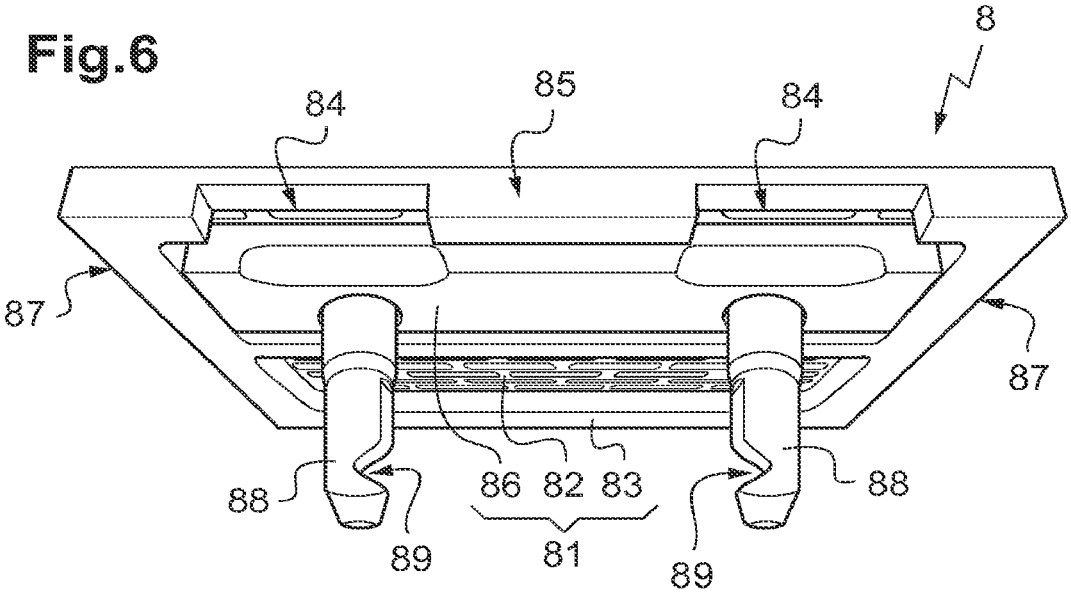
FIG. 6 is a perspective view at a different angle of the forming block of the forming device of FIGS. 2 to 4.

As can be seen clearly in FIGS. 5 and 6, the main part 81 of the forming block 8 has a base 83 with a rectangular shape, which carries a perforated grille 82 on one of its faces. This grille 82 is intended to have the blanket 15 bearing against it. The dimension of the grille 82 parallel to a lateral edge 85 of the base 83 is substantially the same as the dimension of the grille 62 of the flight 6 parallel to the lateral edge 65. Thus, the grille 82 of the forming block is able to cover the grille 62 in the vicinity of the lateral edge 65, extending along the entire length of the edge 65, as shown in FIG. 2.

At the rear of the grille 82 and in the vicinity of the lateral edge 85, the base 83 has a cavity in which a support 86 carrying two pins 88 is mounted. Each pin 88 is centred on a longitudinal axis $X_{88}$ and extends perpendicularly to the support 86, which for its part is parallel to the mean plane of the base 83. Laterally, the support 86 has screws 80 which are able to move in slots provided in the lateral edges 87 of the base 83, where the edges 87 are the edges perpendicular to the edge 85. Thus, the support 86 is able to be slid in a direction perpendicular to the edge 85, so as to adjust the distance d between the pins 88 and the lateral edge 85. In practice, this makes it possible to change the position of the main part 81 of the forming block 8 with respect to the lateral edge 65 of the flight, and thus to modify the width of the form created in the blanket 15, for example between two productions. Two openings 84, which are clearly visible in FIG. 6, are provided in the lateral edge 85, each opening being substantially aligned with a pin 88.

The spacing between the pins 88 of the forming block and the spacing between the housings 96 of the anchoring casings are provided to be the same, such that when the main part 81 of the forming block is opposite the receiving surface 63 of the flight 6, the axes $X_{88}$ of the two pins 88 can be aligned with the axes $X_{96}$ of the two housings 96 of the anchoring casings 9, as shown in FIG. 4. Each pin 88 of the forming block is designed to be received in a housing 96 and to engage by snap-fastening with the corresponding leaf spring 98. To this end, each pin 88 has a notch 89 which is complementary to a raised motif 99 on the leaf spring.

When the main part 81 of the forming block is opposite the receiving surface 63 of the flight 6 in the configuration of FIG. 4, the notches 89 in the two pins 88 are able to be engaged with the motifs 99 on the housings 96 by the application of a one-way pushing force $F_1$ that pushes the main part 81 of the forming block towards the receiving surface 63, in a transverse direction X with respect to the receiving surface, as shown by the arrow $F_1$ in FIG. 4.

The pushing force $F_1$ causes the entry of each pin 88 into the corresponding housing 96, until the motif 99 is engaged in the notch 89. The motif 99 on each leaf spring 98 has an entry surface $S_1$ which forms a hard point for the engagement of the notch 89 and the motif 99. This entry surface $S_1$ is inclined with respect to the direction X of the force $F_1$ at an angle $\alpha_1$ equal to 45°. The male snap-fastening member 99 and female snap-fastening member 89, and in particular the angle $\alpha_1$, are designed such that the amplitude of the pushing force $F_1$ corresponds to a force that can be applied by a human, possibly with the aid of a mallet, without requiring an electric tool.

When the notches 89 are engaged with the motifs 99, the forming block 8 is mounted in a reliable and robust manner on the flight 6. Advantageously, since snap-fastening employs the motifs 99 formed by the leaf spring 98, the forming block is elastically retained with respect to the flight, which withstands the vibrations inherent to the operation of the conveyor.

Once the forming block 8 has been mounted on the flight, it is possible to remove it easily by applying a separating force $F_2$ for separating the forming block from the receiving surface 63 in the transverse direction X with respect to the receiving surface, this causing the disassembly of the snap-fastening members 89 and 99. The motif 99 on each leaf spring 98 has a retaining surface $S_2$ which forms a hard point for the disassembly of the snap-fastening members 89 and 99. This retaining surface $S_2$ is inclined with respect to the direction X of the separating force $F_2$ at an angle $\alpha_2$ equal to 45°, as can be seen in FIG. 4.

Figure 7:
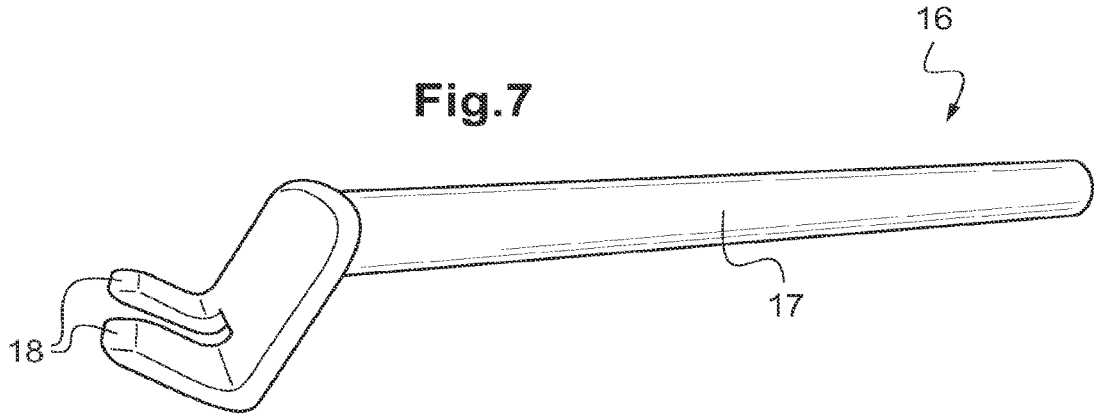
FIG. 7 is a perspective view of a claw for removing the forming device of FIGS. 2 to 4.

Advantageously, the separating force $F_2$ for separating the forming block 8 from the receiving surface 63 can be applied through the openings 84 provided in the lateral edge 85 of the main part 81 of the forming block, with the aid of an appropriate tool. An example of an appropriate tool is shown in FIG. 7. This is a removal claw 16 having an elongate handle 17 and two inclined teeth 18 that are formed at one end of the handle. The teeth 18 are able to enter the openings 84 in the forming block. Thus, it is possible, by inserting the teeth 18 into the openings 84 and acting on the handle 17, to locally apply, in alignment with each of the two pins 88, the separating force $F_2$ for separating the forming block 8 from the receiving surface 63, as shown by the arrows $F_2$ in FIG. 3.

In the state in which the forming block 8 is mounted on the flight 6, the openings 84 are located at the front of the receiving surface 63 and directed towards the edge of the conveyor. An operator can thus remove the forming block 8 from outside the oven 2, while the conveyor is operating at reduced speed, by inserting the teeth 18 of the removal claw 16 into the lateral openings 84 in the forming block and by applying the separating force $F_2$ by acting on the handle 17 so as to disassemble the snap-fastening members 89 and 99. Once disconnected from the flight 6, the forming block 8 is conveyed towards the outlet of the oven by the conveyor.

Figure 8:
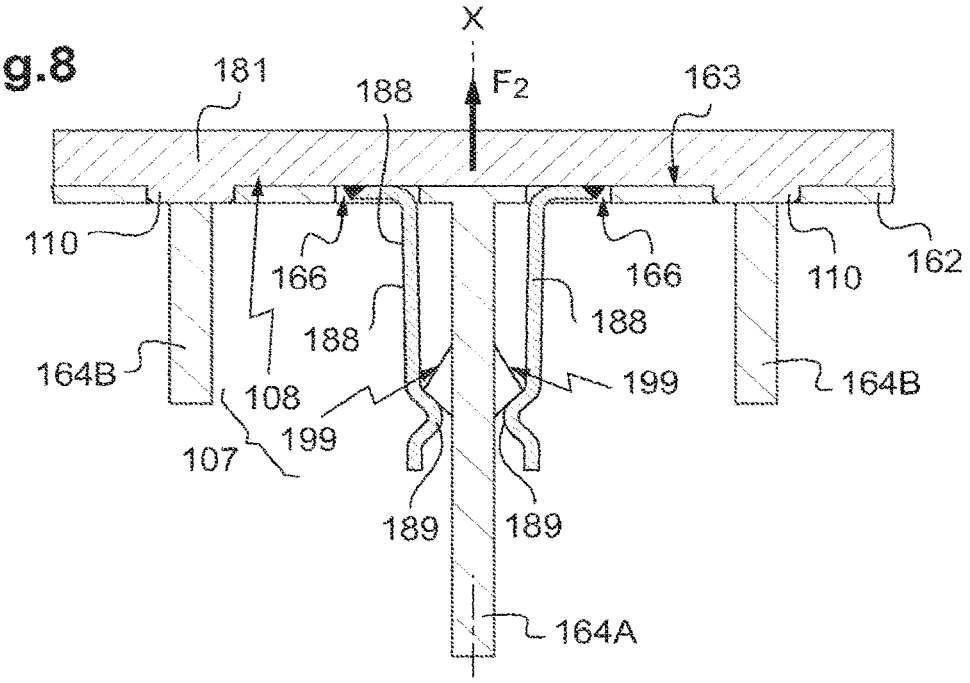
FIG. 8 is a cross section similar to FIG. 3 for a second embodiment of the invention.
Figure 9:
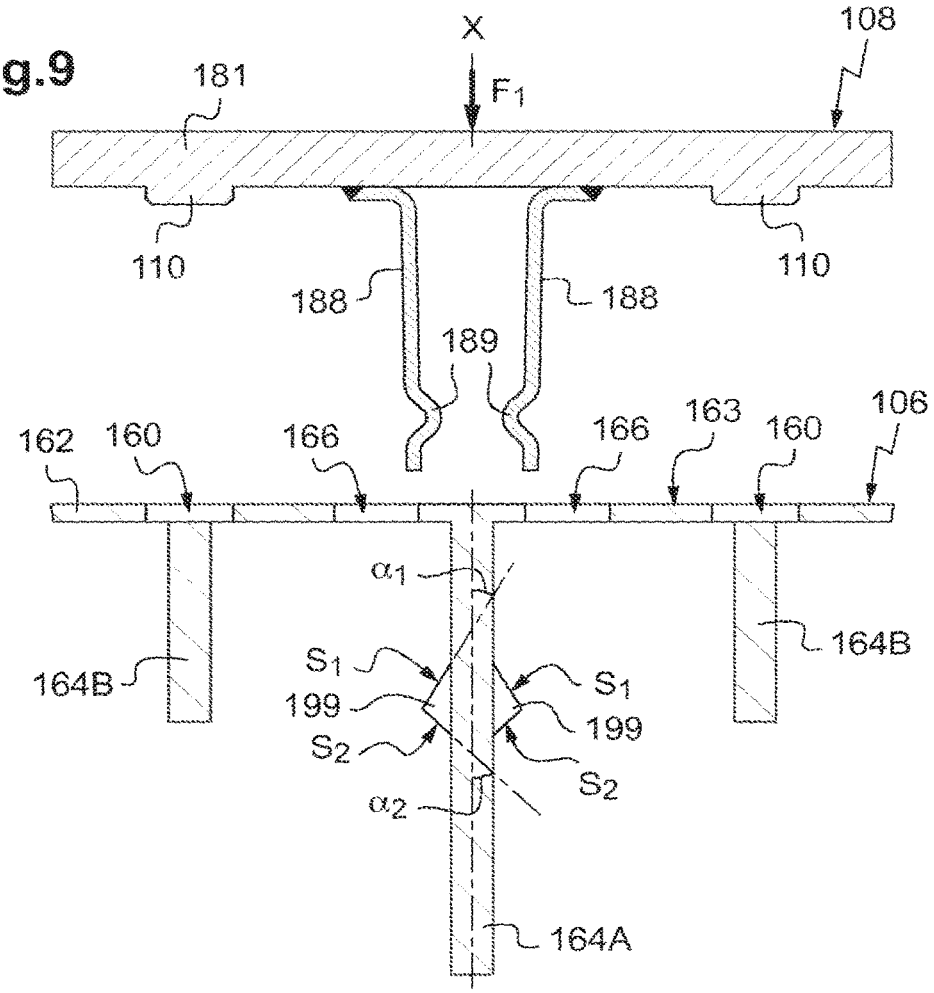
FIG. 9 is a cross section similar to FIG. 8 but in an exploded view.

In the second embodiment shown in FIGS. 8 and 9, elements that are similar to those in the first embodiment have the same references increased by 100. This second embodiment employs a second known model of conveyor flight 106, still having a perforated grille 162 with a rectangular shape, which defines a receiving surface 163 at the rear of which three ribs 164A and 1646 extend. In this second flight model, the central rib 164A has a height, taken perpendicularly to the grille 162, which is greater than the height of the two lateral ribs 164B.

In this second embodiment, the forming device 107 has a forming block 108 and anchoring pegs 199, where the shape of the snap-fastening members has been adapted to the flight model 106. Specifically, the central rib 164A of the pallet has been used to carry two anchoring pegs 199 which are located on either side of the rib, while the main part 181 of the forming block 108 carries two leaf springs 188 that are able to engage by snap-fastening with the anchoring pegs 199. To this end, each leaf spring 188 has a raised motif 189 which is complementary to an anchoring peg 199. When the main part 181 of the forming block is opposite the receiving surface 163 of the flight 106 in the configuration of FIG. 9, the two leaf springs 188 are able to be inserted into the orifices 166 provided to this end in the grille 162 of the flight, so as to bring the motifs 189 on the leaf springs into engagement with the anchoring pegs 199 by the application of a one-way pushing force $F_1$ that pushes the main part 181 of the forming block towards the receiving surface 163, in a transverse direction X with respect to the receiving surface, as shown by the arrow $F_1$ in FIG. 9.

Each anchoring peg 199 has an entry surface $S_1$ which forms a hard point for the engagement of the snap-fastening members 189 and 199. This entry surface $S_1$ is inclined with respect to the direction X of the force $F_1$ at an angle $\alpha_1$ equal to 30°, thereby allowing the passage of the hard point during the application of the pushing force $F_1$. The angle $\alpha_1$ of 30° makes it easier to engage the snap-fastening members compared with an angle of 45°. Here again, the snap-fastening members 189 and 199 are designed such that the amplitude of the pushing force $F_1$ corresponds to a force that can be applied by a human, possibly with the aid of a mallet.

Advantageously, the snap-fastening members are located in the vicinity of the central rib 164A and housed in the internal volume defined by the flight 106 at the rear of the receiving surface 163, this making it possible to limit the impact on the circulation of hot air in the oven. However, in this embodiment, on account of the concentration of snap-fastening members in the vicinity of the central rib 164A, there is a risk that the forming block 108 will be driven in rotation during the passage of the blanket of fibres. In order to remedy this, the main part 181 of the forming block 108 has anti-rotation protrusions 110 that are intended to be housed in corresponding hollows 160 provided in the flight 106.

As in the first embodiment, once the forming block 108 has been mounted on the flight 106, it is possible to remove it easily by applying a separating force $F_2$ for separating the forming block from the receiving surface 163 in the transverse direction X with respect to the receiving surface, as shown by the arrow $F_2$ in FIG. 8, so as to cause the disassembly of the snap-fastening members 189 and 199. Each anchoring peg 199 has a retaining surface $S_2$ which forms a hard point for the disassembly of the snap-fastening members. This retaining surface $S_2$ is inclined with respect to the direction X of the separating force $F_2$ at an angle $\alpha_2$ equal to 45°. As before, at least one lateral opening, not shown in the figures, is provided on the forming block 108 so as to allow an operator to apply the separating force $F_2$ through this opening with the aid of an appropriate tool.

As is apparent from the above-described embodiments, it is particularly easy and rapid to mount and remove a forming device in accordance with the invention.

In particular, once the anchoring element, for example in the form of anchoring casings or anchoring pegs, has been fixed to the flight at the rear of the receiving surface, the forming block can be mounted just with human force, optionally assisted with a hand tool such as a mallet, by applying a pushing force to the forming block in the direction of the receiving surface. Advantageously, this mounting can be implemented even when the conveyor is still hot, since it does not require the insertion of a part of the operator's body into the heating device.

Similarly, the forming block can be removed easily from outside the heating device by passing an appropriate tool, such as the above-described removal claw, through the lateral opening in the forming block, said opening being located at the front of the receiving surface of the flight. Here again, removal can be implemented even when the conveyor is still hot, since the operator acts from outside the heating device. Once disconnected from the flight, the forming block is conveyed towards the outlet of the heating device by the conveyor.

It is thus possible to mount forming blocks on and remove them from the successive flights of a conveyor, which were previously equipped with anchoring elements, in a limited time of around thirty minutes for each, by causing the conveyor to rotate at reduced speed. The risks encountered by the operator during the mounting and removal of the forming blocks according to the invention are very limited compared with the case of the bolted forming blocks of the prior art. Furthermore, there is a significant gain in productivity associated with the possibility of mounting and removing forming blocks while the conveyor is still hot, because a downtime between two productions is removed, knowing that, by way of example when the heating device is an oven, it is generally necessary to wait for around 8 hours in order to cool the oven and around 5 hours to heat it up again.

Furthermore, by virtue of the elastic retention provided by the snap-fastening members, the fixing that is obtained of the forming block on the flight is reliable and robust. It is not possible to lose a forming block during production because the pressure exerted by the fibrous product on account of its crushing causes self-blocking of the snap-fastening members. Advantageously, the structure of the forming device according to the invention makes it possible to equip any type of conveyor, in particular conveyors that are already in service in factories, since it can be adapted to any form of existing flight.

Another advantage of the forming device according to the invention is that it disrupts the circulation of hot air in the heating device very little. Specifically, only the main part of the forming block protrudes from the flight and all the other constituent elements of the forming device are housed in the internal volume of the flight, being moreover particularly compact so as to minimize the shading zones which impair the circulation of the hot air and thus the uniformity of heating. In addition, the forming device according to the invention limits projecting elements at the rear of the flights. Such projecting elements are disadvantageous since they are likely to break the sealing at the rear of the flights, this sealing generally being produced with the aid of brush seals, and this can cause problems in terms, in particular, of the uniformity of the temperature in the heating device and the quality of baking of the fibrous product.

The invention is not limited to the examples described and shown.

In particular, the forming device according to the invention can employ snap-fastening members other than leaf springs and notches or anchoring pegs. The number and shape of the snap-fastening members may also be different from those described above. In addition, the forming device according to the invention may be employed in any type of heating device, in particular in ovens as described above, but also in microwave heating devices or in heating forming presses.

It will also be noted that, even though the invention has been described above for the manufacture of fibrous products made of glass fibres, it is also applicable to the formation of fibrous products with different compositions, with a substantially rigid and elastic nature, in particular comprising mineral fibres such as rock wool, mineral wool or slag wool, and also related siliceous fibres, or even organic fibres which have sufficient rigidity and elasticity characteristics, such as relatively coarse wood fibres. In addition, even though the low-density fibrous products described above are mainly intended to be used as thermal and/or acoustic insulation products, the invention is applicable to the manufacture of panels, slabs, profiled elements and other materials that are intended for different or combined applications, such as decorative panels and panels for the construction of ceilings, which may have a solely decorative or constructive function, or combine a decorative function or constructive function with a thermal and/or acoustic insulation function.

The invention claimed is:

1. A forming device for creating a form in a fibrous product, the forming device configured to be mounted on a flight of a conveyor for transporting the fibrous product through a heating device, the flight defining a receiving surface for the fibrous product, the forming device comprising:

a forming block, a main part of which is configured to be arranged at a front of the receiving surface, and at least one anchoring element configured to be fixed to the flight while being arranged at a rear of the receiving surface, wherein the forming block and the anchoring element comprise complementary snap-fastening members which, when the main part of the forming block is facing the receiving surface and the anchoring element is fixed to the flight at a rear of the receiving surface, are configured to engage by application of a one-way pushing force that pushes the main part of the forming block towards the receiving surface in a transverse direction with respect to the receiving surface.

2. A forming device according to claim 1, wherein the flight defines an internal volume at the rear of the receiving surface, the anchoring element being configured to be housed in the internal volume.

3. A forming device according to claim 1, wherein when they are engaged, the snap-fastening members elastically retain the forming block with respect to the anchoring element.

4. A forming device according to claim 1, wherein at least one of the snap-fastening members includes a leaf spring.

5. A forming device according to claim 4, wherein the leaf spring is made from a metal alloy.

6. A forming device according to claim 1, wherein the snap-fastening member of the anchoring element includes an entry surface which forms a hard point for engagement of the snap-fastening members, the entry surface being inclined with respect to the direction of the pushing force at an angle of less than or equal to 45, to allow passage of the hard point during the application of the pushing force.

7. A forming device according to claim 6, wherein the entry surface is inclined with respect to the direction of the pushing force at an angle between 10° and 30°, to allow passage of the hard point during the application of the pushing force.

8. A forming device according to claim 1, wherein the snap-fastening members are configured to be disassembled by application of a separating force for separating the forming block from the receiving surface, in a transverse direction with respect to the receiving surface.

9. A forming device according to claim 8, wherein the snap-fastening member of the anchoring element includes a retaining surface which forms a hard point for the disassembly of the snap-fastening members, the retaining surface being inclined with respect to the direction of the separating force at an angle of approximately equal to but not greater than 45°, to allow passage of the hard point during the application of the separating force and to ensure that the snap-fastening members are retained sufficiently when engaged.

10. A forming device according to claim 1, wherein the forming block includes at least one opening which, in the configuration in which the forming device is mounted on the flight, is located at a front of the receiving surface, the snap-fastening members configured to be disassembled by application, through the opening, of a separating force for separating the forming block from the receiving surface in a transverse direction with respect to the receiving surface.

11. A forming device according to claim 10, configured to be arranged in a vicinity of a lateral edge of the flight, with the opening in the forming block being oriented towards the lateral edge.

12. A forming device according to claim 1, wherein the forming block comprises at least two snap-fastening members projecting from its main part, the snap-fastening members each configured to engage with a snap-fastening member of the anchoring element.

13. A forming device according to claim 1, further comprising anti-rotation elements for preventing the forming block from rotating with respect to the anchoring element or with respect to the receiving surface.

14. A forming device according to claim 1, wherein the main part of the forming block is perforated.

15. A device for manufacturing a fibrous product, comprising:

a heating device;

a lower conveyor and an upper conveyor which circulate in the heating device, each conveyor comprising a plurality of flights that each define a receiving surface for the fibrous product, the lower and upper conveyors being configured to compress the fibrous product between the receiving surfaces when they transport the fibrous product through the heating device;

wherein at least one of the lower conveyor and upper conveyor includes at least one flight that includes a forming device according to claim 1.

16. A manufacturing device according to claim 15, wherein the forming device is arranged in a vicinity of a lateral edge of the conveyor.

17. A manufacturing device according to claim 15, wherein the lower conveyor includes forming devices that equip the flights on one edge of the two facing conveyors, while the upper conveyor includes forming devices that equip the flights on the opposite edge of the two facing conveyors.

* * * * *